US007857678B2

(12) United States Patent
Isenberg

(10) Patent No.: US 7,857,678 B2
(45) Date of Patent: Dec. 28, 2010

(54) TOY WITH CUSTOMIZATION FEATURE

(76) Inventor: Barbara L. Isenberg, 151 Central Park West, New York, NY (US) 10023

( * ) Notice: Subject to any disclaimer, the term of this patent is extended or adjusted under 35 U.S.C. 154(b) by 0 days.

(21) Appl. No.: 11/490,696

(22) Filed: Jul. 21, 2006

(65) Prior Publication Data

US 2006/0258256 A1 Nov. 16, 2006

Related U.S. Application Data

(63) Continuation of application No. 10/699,080, filed on Oct. 31, 2003, now Pat. No. 7,244,164, which is a continuation-in-part of application No. 10/425,182, filed on Apr. 29, 2003, now abandoned.

(60) Provisional application No. 60/376,298, filed on Apr. 29, 2002.

(51) Int. Cl.
*A63H 3/36* (2006.01)
*A63H 3/16* (2006.01)

(52) U.S. Cl. ..... 446/268; 446/369; 446/391

(58) Field of Classification Search ..... 446/369, 446/370, 374, 382, 268, 321, 391; 273/85 B; 434/236, 237
See application file for complete search history.

(56) References Cited

U.S. PATENT DOCUMENTS

| | | | | | |
|---|---|---|---|---|---|
| 1,551,050 | A | | 8/1925 | Parsons | 446/139 |
| 1,608,353 | A | | 11/1926 | Zaikine | 472/12 |
| 2,036,076 | A | | 3/1936 | Philippl | 446/135 |
| 2,213,901 | A | * | 9/1940 | Crawford | 446/139 |
| 2,637,138 | A | | 5/1953 | Doran et al. | 446/83 |
| 2,663,967 | A | | 12/1953 | Mathis | 446/83 |
| 2,767,517 | A | | 9/1956 | Hooper | 414/335 |
| 2,814,909 | A | | 12/1957 | Knowles | 446/135 |
| 3,091,459 | A | | 5/1963 | Lindman | 273/108.4 |
| 3,462,873 | A | | 8/1969 | Moreci | 446/135 |
| 3,583,702 | A | | 6/1971 | Glass et al. | 273/443 |
| 3,624,691 | A | * | 11/1971 | Robson et al. | 446/374 |
| 3,699,703 | A | | 10/1972 | Biecker | 446/83 |
| 3,888,233 | A | | 6/1975 | Ware | 600/28 |
| 3,946,520 | A | | 3/1976 | Goldfarb et al. | 446/135 |
| 4,233,778 | A | | 11/1980 | Lemelson | 446/92 |
| 4,320,883 | A | * | 3/1982 | Bass | 248/104 |
| 4,356,658 | A | | 11/1982 | Goldfarb | 446/83 |
| 4,805,270 | A | * | 2/1989 | Kimbrough | 24/712.3 |
| 4,834,371 | A | * | 5/1989 | Hay et al. | 273/108.51 |
| 4,964,836 | A | * | 10/1990 | Kamei | 446/374 |
| 4,971,313 | A | | 11/1990 | Hucks | 472/81 |
| 5,072,843 | A | * | 12/1991 | James | 215/395 |
| 5,318,469 | A | * | 6/1994 | Unalp et al. | 446/73 |
| 5,885,128 | A | | 3/1999 | Blaustein et al. | 446/369 |
| 6,494,763 | B1 | | 12/2002 | Hastey | 446/376 |
| 6,565,407 | B1 | | 5/2003 | Woolington et al. | 446/175 |

FOREIGN PATENT DOCUMENTS

WO WO 9850126 A1 11/1998

* cited by examiner

*Primary Examiner*—Kien T Nguyen
(74) *Attorney, Agent, or Firm*—St. Onge Steward Johnston & Reens LLC

(57) ABSTRACT

A toy is provided comprising a plush figure with a hole passing through a body part thereof, and an accessory for removable attachment to the figure, for customizing the toy.

15 Claims, 5 Drawing Sheets

TOY WITH CUSTOMIZATION FEATURE

PRIOR APPLICATION

This application is a continuation of U.S. patent application Ser. No. 10/699,080, filed Oct. 31, 2003 now U.S. Pat. No. 7,244,164, and which is a continuation-in-part of U.S. patent application Ser. No. 10/425,182 filed Apr. 29, 2003, which since has been abandoned, and which claims priority to U.S. Provisional Patent Application No. 60/376,298, filed Apr. 29, 2002.

FIELD OF THE INVENTION

The present invention relates to a toy that is customized with accessories. The present invention relates to a toy with a dressing and/or customization feature.

BACKGROUND OF THE INVENTION

Dressable toys are known. Such toys include figures of real or imaginary people, animals, characters or other beings. These toys include dolls, stuffed animals and paper-dolls. Bears are particularly popular plush figures and are often dressed to simulate real or imaginary people, animals, characters or other beings. Typically, clothing includes snaps or buckles and accessories are added to the figure using elastic bands.

The demand for more sophisticated toys grows, and there exists a need to develop better methods of attaching clothing and other accessories to toys. There exists a need to provide more appealing and sophisticated toys that serve as learning tools and aid in the development of hand-eye coordination in children.

SUMMARY OF THE INVENTION

The present invention relates to a toy comprising a figure with a hole in a portion thereof for receiving an accessory.

DETAILED DESCRIPTION OF THE DRAWINGS

The present invention provides several new techniques for customizing figures with accessories and for animating or moving figures. Using whimsical and attractive figures to teach children how to dress by associating accessories, including clothing, with relative parts of a body is an effective way to stimulate development in young children. Sophisticated attachment means allowing children to repeatedly dress and undress a figure, and features allowing children to move and animate the figure both serve to improve hand-eye coordination in children. Further, plush figures are very appealing and soothing to children who may cuddle the plush figure.

The range of items used to customize toys includes reproductions of things such as sports equipment and other gear used to pursue the vocation or avocation for which the figure is being "dressed."Examples include an easel and palette for a painter teddy bear, a backpack and boots for a hiking teddy bear, a messenger bag and calculator for a student teddy bear, and so on. Thus, the toy may be customized for the owner or recipient.

Figures may be modified in shape and/or by the addition of features to their interior or exterior fabric which facilitate the attachment of accessories to customize the toy and which facilitate movement and animation of the toy by the child. Specifically, modification to various body parts or surfaces of the figure allow for customization.

The term "figure" as used herein means any real or imaginary being, person, or animal. Figure may be filled with stuffing, having an outer surface made of plush fabric, leather, vinyl or other appropriate material for a stuffed figure, such as a doll, teddy bear or the like.

Figure 1:
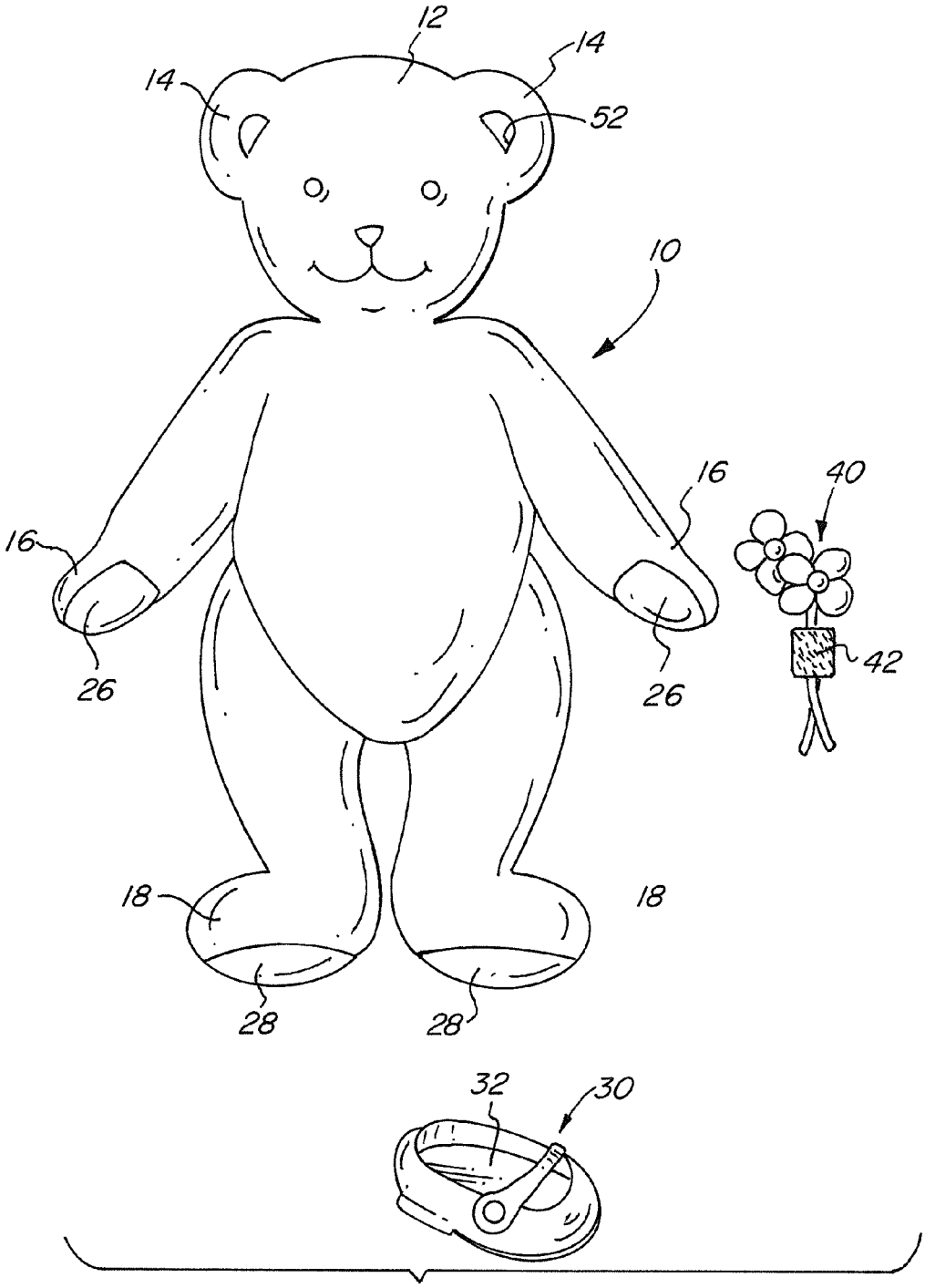
FIG. 1 is frontal view of an embodiment of the present invention.

FIG. 1 shows generally a figure 10 in the form of a plush stuffed bear including body parts such as head 12, ears 14, hands or "front paws" 16, and feet or "back paws" 18. Front paws 16 may have front paw pads 26, and back paws 18 may have back paw pads 28.

Various accessories may be configured to be received by the various body parts of figure 10. Shown in FIG. 1, accessory 40 is in unattached position. In this embodiment, accessory 40 is a bunch of flowers and configured to be received by paw 16. Accessory 40 includes attachment surface 42. Front paw pads 26 is modified to provide a surface for receiving attachment surface 42 so that the plush figure 10 receives accessory 40. These surfaces 26, 42 act together to achieve attachment of accessory 40 to figure 10. This may be accomplished by a hook and loop fastener, a snap, or like, with respective portions placed on each surface which act together to put accessory 40 in attached position. Alternatively, portions of surface fabric of the figure may be slightly modified in particular areas as to be hook and loop fastener-friendly, and enable the surface fabric of the figure to grasp or receive particular types of accessories as described herein.

The attachment means may vary in difficulty and be customized to the age of the child and their stage of development in term of small motor skills. Similarly, back paw pads 28 provide a desired surface to receive an item of clothing, specifically a shoe 30, in the embodiment shown in FIG. 1. The inner sole of the shoe has an attachment surface 32 to be matched to a relative surface on the back paw pad 28 of the plush figure. In attached position, back paw 18 receives shoe 30.

The present invention requires children to discern which body part of figure appropriately receives each accessory, teaching them how to dress the figure and likewise themselves. The present invention provides an appealing learning tool for children. Additionally, the present invention requires that children manipulate their hands and fingers to attach accessories and animate or move the figure. The ability to control and coordinate the small muscles of the wrist, hand and fingers aids in the development of small motor skills and hand-eye coordination in children. The appeal of a decorative, customized plush toy makes dressing process interesting and the work required to dress or animate the plush toy desirable and fulfilling to children. Dressing the figure challenges children while also facilitating the activity by providing sophisticated and easy-to-us attachment means, such as a hook and loop fastener.

The figure itself may be modified, such as in shape, to facilitate dressing in several ways. Firstly, accessories such as jewelry, ribbons, or other material can be threaded or passed through holes in various body parts of the figure to achieve attachment to the desired body part and dressing of the plush figure. For example, a hole or aperture in the ear of the bear facilitates attachment of hair ornaments and jewelry. This is particularly useful for attaching headgear, such as a bow or a tiara. The surface of the figure may be modified in texture, such as a fabric that will catch and stick to hook and loop fastener, or by the addition of attachment means, such as snaps, buttons, hook and loop fastener.

The figure may contain wiring, hinging or other suitable material allowing at least portions of figure to be bent, posed, or otherwise moved, and further providing a means to receive an accessory. For instance, the arm of the figure may be bent at its elbow, so as to be able to receive and hold in place a purse or bag.

The figure may contain ferrous portions allowing at least portions of the figure to interact with a magnet or magnetic accessory manipulated by the child to move, animate or dress the figure.

Figure 2:
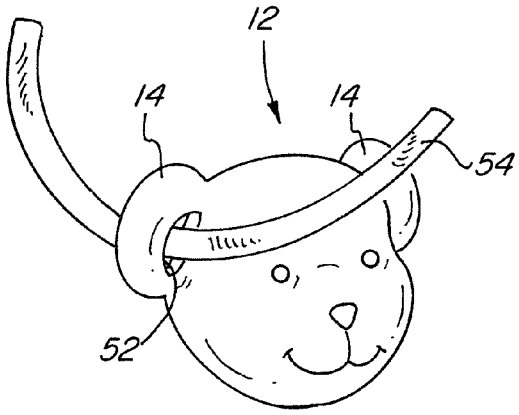
FIG. 2 is a partial perspective view of the embodiment shown in FIG. 1.
Figure 3:
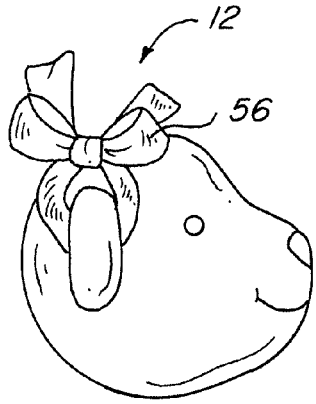
FIG. 3 is a partial side view of the embodiment shown in FIG. 1.

FIG. 2 shows generally head 12 of plush figure 10 shown in FIG. 1, including ears 14 and ear hole 52. Ear hole 52 can be used to attach accessories in several ways. An item of clothing or an accessory may be threaded directly though the ear hole 52 for attachment to the plush figure. As shown in FIG. 2, accessory 54 is a ribbon which is drawn through hole 52. FIG. 3 is a side view of head 12 in which accessory 54 is in attached position as the ribbon 54 has been tied into bow 56.

Figure 4:
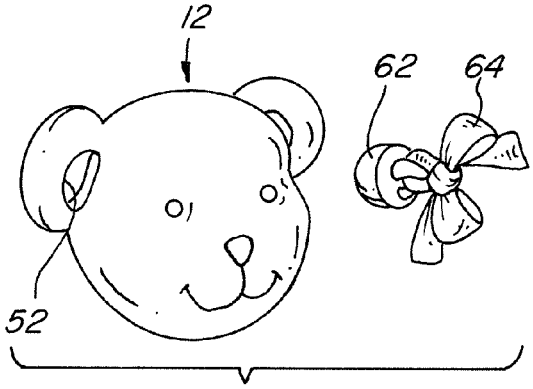
FIG. 4 is partial perspective view of the embodiment shown in FIG. 1
Figure 5:
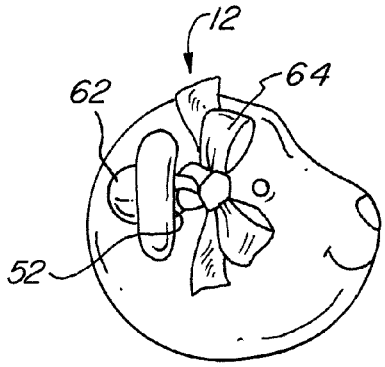
FIG. 5 is a side view of the embodiment shown in FIG. 1.
Figure 6:
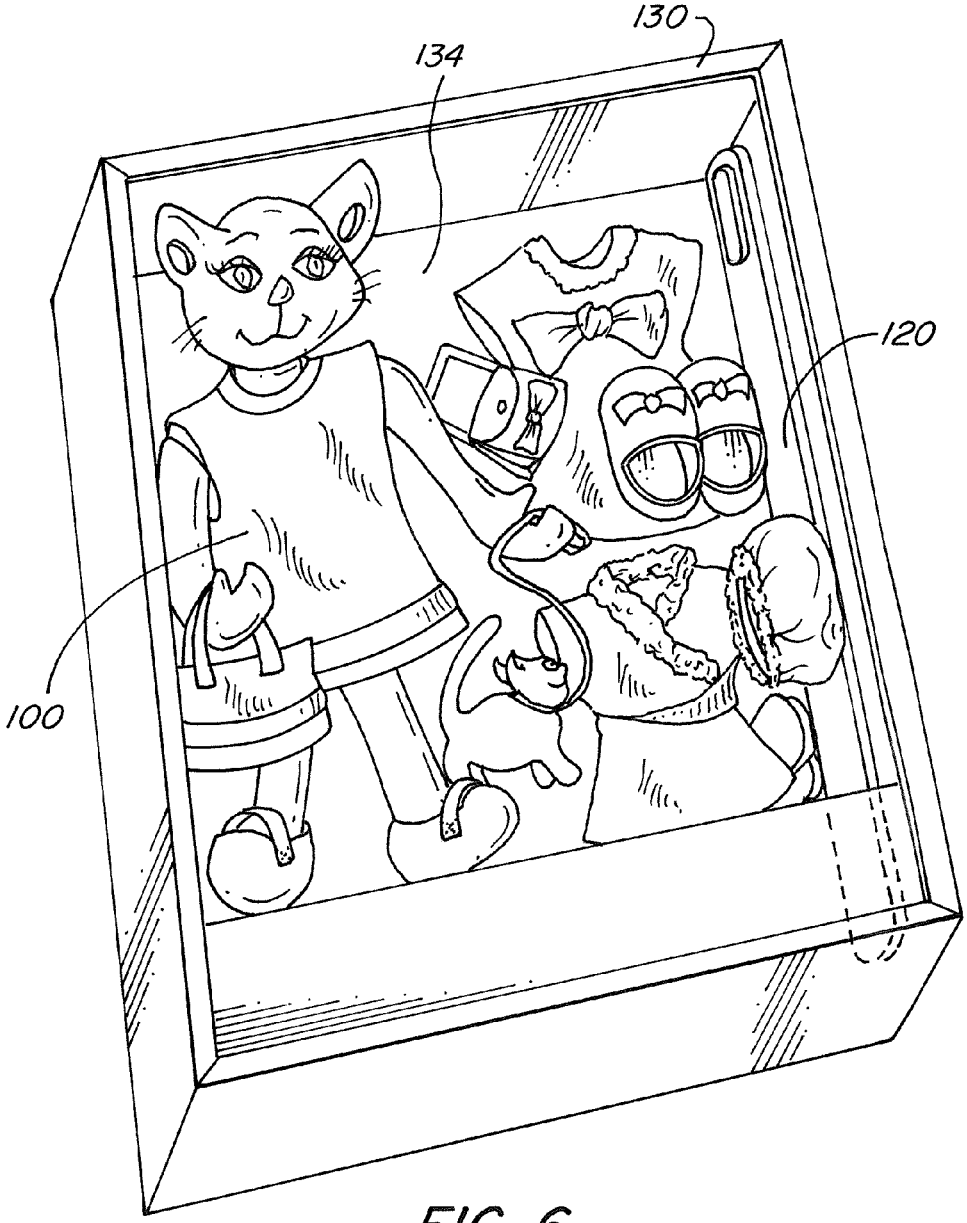
FIG. 6 is a perspective view of an embodiment of the present invention shown in FIGS. 1-5, incorporating additional features.
Figure 7:
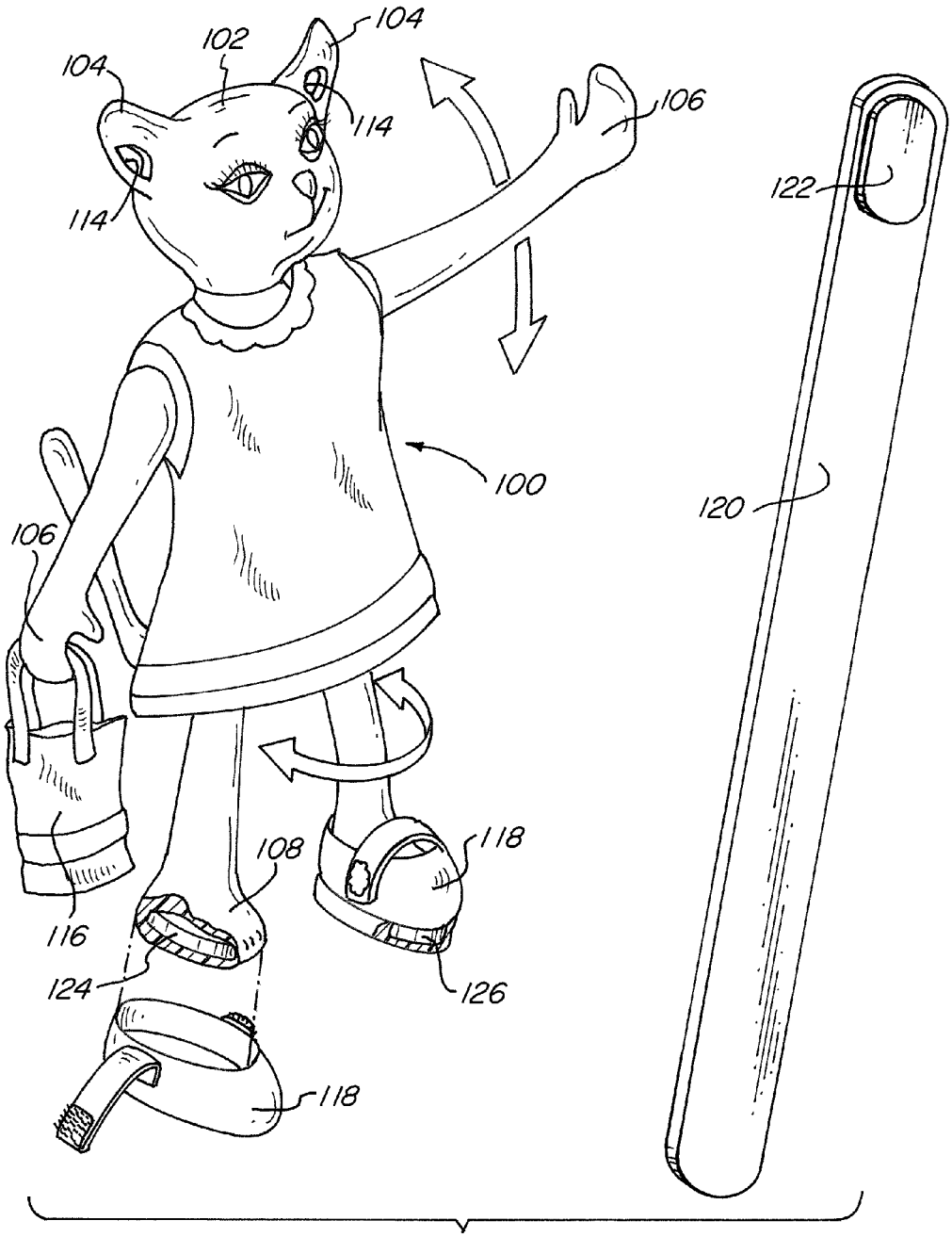
FIG. 7 is a perspective view of the figure and manipulator of the embodiment shown in FIG. 6.
Figure 8:
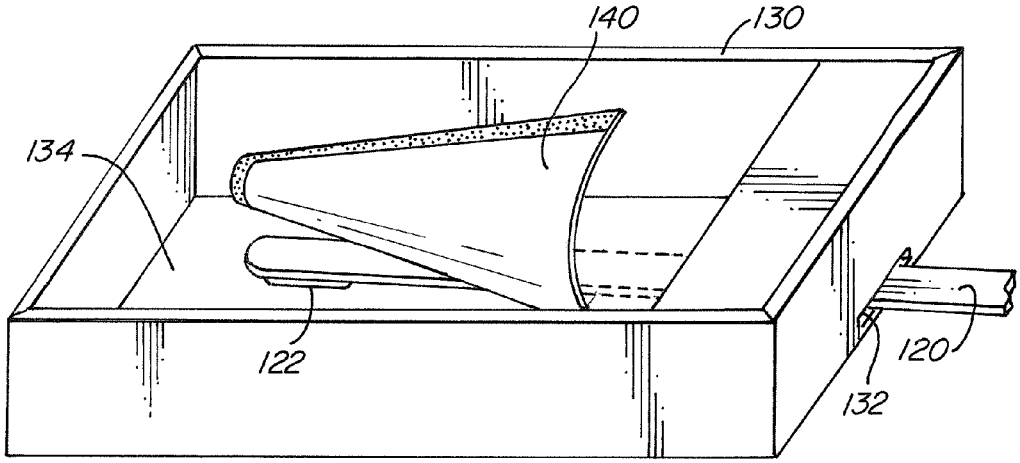
FIG. 8 is a rear perspective view the stage of the embodiment shown in FIG. 6.
Figure 9:
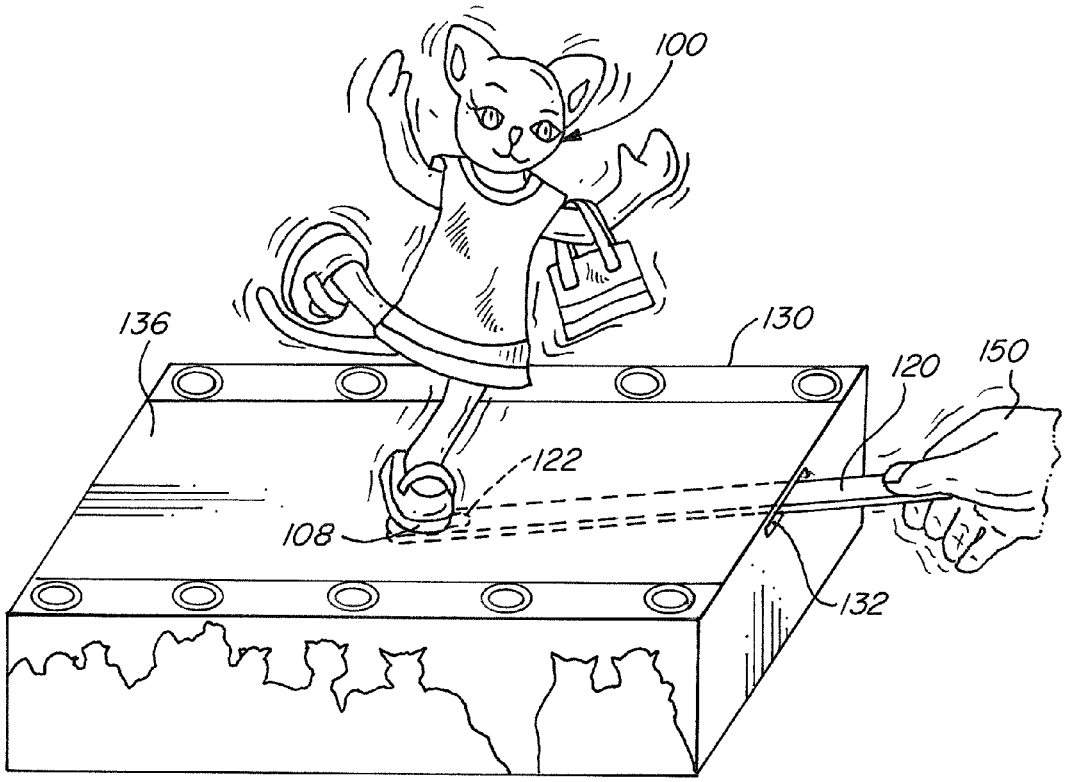
FIG. 9 is a perspective view of the embodiment shown in FIG. 6.

Secondly, accessories may include attachment means such as bands, ribbons, or straps, to be passed through an aperture in a body part of the plush figure, such as ear hole 52, to achieve attachment of accessory in the appropriate area. Thirdly, accessories may include buttons that can be passed through holes in the plush figure to attach accessories. FIG. 4 shows generally head 12, with ear 14 and ear hole 52. Ear hole 52 is configured to receive accessory, specifically bow 64, shown in unattached position. Button 62 to which bow 64 has been tied or otherwise attached, facilitates attachment of bow 64 to ear hole 52 of plush toy. FIG. 5 shows ear hole 52 having received button 62 so as to place bow 64 in attached position.

Accessories may include clothing, shoes, hats, jewelry, sports uniforms and equipment, and other apparel and objects related to particular themes, athletics, hobbies, occupations, or other pastimes. Accessories may include objects which relate to a particular vocation, avocation, or theme for which the plush toy is being dressed or customized. Accessories may include jewelry such as earrings, necklaces and the like, headwear such as hats, visors, tiaras, barrettes, bows, ribbons, and the like, purses, backpacks, sports equipment such a tennis racquet, and other whimsical handheld items such as wands and flower bouquets.

The accessories may relate to any common theme. One example is a beach theme, which may include a swimsuit, sunglasses, a beach pail and shovel. Another example is a baseball theme, which may include a baseball uniform, cleats, ball, glove, and cap. Another example is a princess theme, which may include a dress, wand and tiara.

What is claimed is:

1. A method for teaching children and assisting children with development, comprising the steps of:

providing a doll with at least one body part selected from a group consisting of a head, ear, hand and foot, wherein the at least one body part is made of a material that forms the contour of the at least one body part such that a hole is disposed within the contour of the at least one body part;

wherein the hole occupies a substantial portion of the body part and passes completely through the body part from a first exterior surface of the body part to a second exterior surface of the body part;

providing at least one button that comprises an outer surface with an outer circumference that corresponds to an inner circumference of the hole, such that the button is secured within the hole when the outer surface of the button is disposed within the hole;

placing the at least one button in the hole and removing the at least one button from the hole;

providing at least one ribbon; and threading the at least one ribbon through the hole, tying the at least one ribbon to the at least one body part, untying the at least one ribbon from the at least one body part, and removing the at least one ribbon from the hole.

2. The method of claim 1, wherein the button further comprises an accessory related to a theme coupled to the button.

3. The method of claim 1, wherein the material that forms the contour of the at least one body part forms a representative aspect of the at least one body part and the hole is disposed about the remainder of the body part.

4. The method of claim 3, wherein the at least one body part is an ear of the doll.

5. The method of claim 4, wherein the doll is a plush doll.

6. The method of claim 1, further comprising the step of providing a multiplicity of accessories related to a common theme to be removably received by the doll.

7. The method of claim 6, wherein the doll has at least one modified surface to removably receive the accessories.

8. The method of claim 1, further comprising the step of providing a manipulator having a magnet, and wherein the doll has at least one ferrous portion permanently embedded completely within the interior of the doll for interacting with the manipulator to animate the doll.

9. A toy comprising:

a doll with at least one body part selected from a group consisting of a head, ear, hand and foot, wherein the at least one body part is made of a material that forms the contour of the at least one body part such that a hole is disposed within the contour of the at least one body part;

wherein the hole occupies a substantial portion of the body part and passes completely through the body part from a first exterior surface of the body part to a second exterior surface of the body part;

at least one button that comprises an outer surface with an outer circumference that corresponds to an inner circumference of the hole;

wherein the hole receives the at least one button and secures the button within the hole when the outer surface of the button is disposed within the hole;

wherein an object related to a theme is coupled to the button; and at least one ribbon threaded through the hole and tied to the material that forms the contour of the at least one body part;

wherein the at least one ribbon can be removed from the body part by untying the at least one ribbon from the at least one body part and removing the at least one ribbon from the hole;

wherein the at least one ribbon can be reattached to the at least one body part by threading the at least one ribbon through the hole and tying the at least one ribbon to the at least one body part.

10. The toy of claim 9, wherein the material that forms the contour of the at least one body part forms a representative aspect of the at least one body part and the hole is disposed about the remainder of the body part.

11. The toy of claim 10, wherein the at least one body part is an ear of the doll.

12. The toy of claim 11, wherein the doll is a plush doll.

13. The toy of claim 12, further comprising a multiplicity of accessories related to a common theme to be removably received by the doll.

14. The toy of claim 13, wherein the doll has at least one modified surface to removably receive the accessories.

15. The toy of claim 14, further comprising a manipulator having a magnet, and wherein the doll has at least one ferrous portion permanently embedded completely within the interior of the doll for interacting with the manipulator to animate the doll.

* * * * *